United States Patent [19]

Khudaverdian

[11] 4,407,460

[45] Oct. 4, 1983

[54] AUTOMATIC TOW ROPE REWINDER

[76] Inventor: Vreij Khudaverdian, c/o ADNOC P.O. Box 7181, Abu Dhabi U.A.E., Saudi Arabia

[21] Appl. No.: 246,307

[22] Filed: Mar. 23, 1981

[51] Int. Cl.[3] ..... B65H 75/40; B65H 75/48

[52] U.S. Cl. ..... 242/86.5 A; 242/107; 114/252; 114/254

[58] Field of Search ..... 242/86.5 A, 107, 106; 280/480; 114/253, 254, 252; 248/549, 548, 475 B; 403/327, 330; 15/210 B; 104/173 ST

[56] References Cited

U.S. PATENT DOCUMENTS

| | | | |
|---|---|---|---|
| 2,572,586 | 10/1951 | Hallberg | 242/107 |
| 2,611,146 | 9/1952 | Buckley | 15/210 B |
| 2,657,414 | 11/1953 | Miller et al. | 15/210 B |
| 2,721,088 | 10/1955 | Ritter, Jr. | 280/480 |
| 2,915,259 | 12/1959 | Force | 242/107 |
| 3,547,371 | 12/1970 | Gruseck | 242/86.5 A |
| 3,791,096 | 2/1974 | Epperlein | 403/327 X |
| 4,105,347 | 8/1978 | Gossage | 403/327 X |

*Primary Examiner*—John M. Jillions
*Attorney, Agent, or Firm*—Richard L. Miller

[57] ABSTRACT

A spring-biased reel on which a tow rope is wound, the reel being contained in a housing having means for being attached either to a boat towing a water skier, or a snowmobile towing a snow skier, and a spring-loaded clutch for disengaging the device from the boat or snowmobile in case of excessive towing force.

1 Claim, 4 Drawing Figures

AUTOMATIC TOW ROPE REWINDER

BACKGROUND OF THE INVENTION

Tow ropes generally used to pull skiers are usually just singly tied to the towing vehicle by means of a knot made on the rope, so that if the skier drops his hold of the tow rope, the rope then continues to drag behind the vehicle, and forms a hazard to other skiers or other objects along the way. This situation is objectionable, and is therefore in need of an improvement.

SUMMARY OF THE INVENTION

Accordingly it is a principal object of the present invention to provide an automatic tow rope rewinder on which a tow rope will automatically wind up, in case a skier releases his hold thereof.

Another object is to provide an automatic tow rope rewinder which may be made to automatically disconnect from the towing vehicle, in case of an excessive towing pull, so as to not continue pull on the skier in case he is in any trouble such as hung up on any interfering object or the like.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF THE PREFERRED EMBODIMENT

Figure 1:
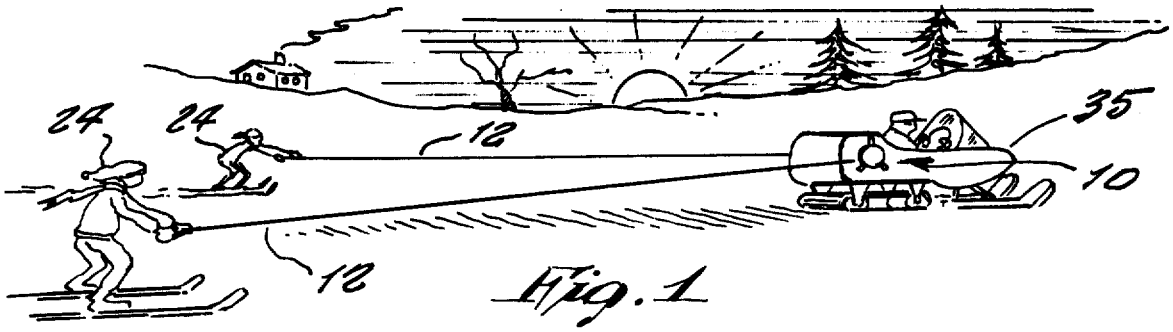
FIG. 1 is a perspective view of the invention on a snowmobile so as to tow a skier.
Figure 2:
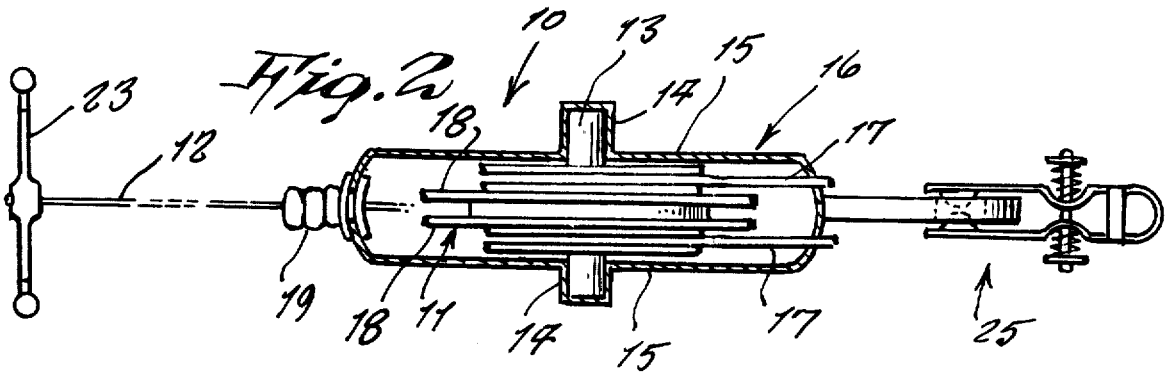
FIG. 2 is a top view of the invention.
Figure 3:
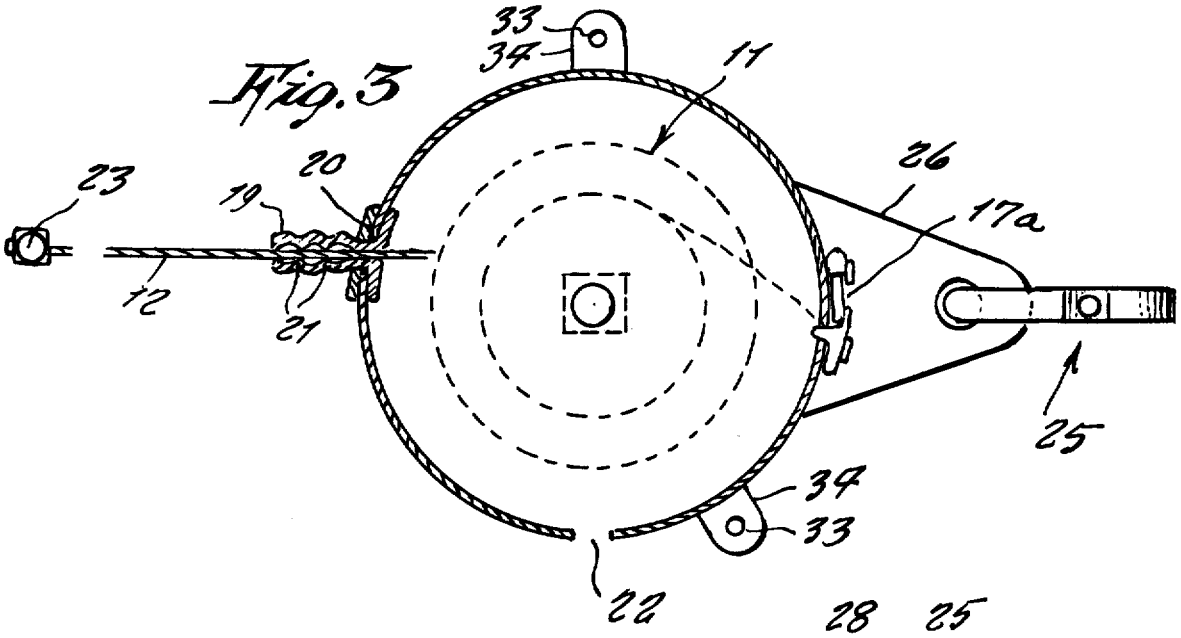
FIG. 3 is a side view thereof.
Figure 4:
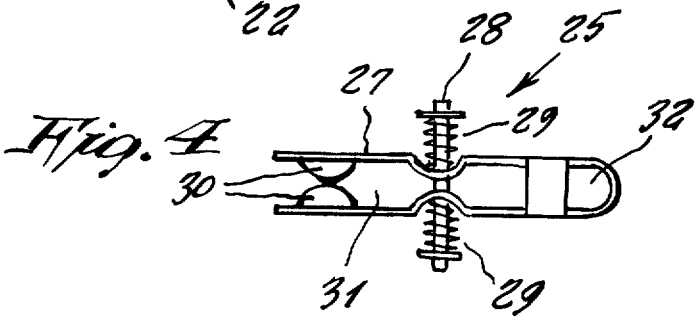
FIG. 4 is an enlarged view of the safety clamp shown in FIG. 2; which provides an alternate attachment of the invention to the snowmobile.

Referring now to the drawing in greater detail, the reference numeral 10 represents an automatic tow rope rewinder, according to the present invention, wherein there is a reel 11 around which a tow rope 12 can be wound up. The reel is fixedly attached to a shaft 13 passing through the center of the reel. Opposite ends of the shaft are journalled in bearings 14 formed in opposite side walls 15 of a reel case 16 inside which the reel is contained.

A pair of spiral wound, flat leaf springs 17 are each coiled around the shaft; one end of the springs being connected to the shaft, and the other ends thereof being connected to a holder 17*a* on the case; the springs serving to rotate the reel in a reverse direction and rewind the tow rope therearound after having been unwound therefrom, during use.

The reel includes a pair of spaced apart, circular large flanges 18 between which the tow rope is wound up.

A resilient rubber fitting 19 lines a hole 20 through which the tow rope passes outwardly of the case; the fitting having circular scraper edges 21 for scraping off snow or water from the tow rope when being pulled into the housing. A hole 22 at a bottom of the case, serves for melted snow, water or dust to be discharged outwardly of the case.

One end of the tow rope is secured to the reel. The other end of the tow rope has a handle bar 23 for being grasped in the hand of a skier 24.

The case may be mounted on a boat or snowmobile by means of a safety clamp 25 clipped to a tab or plate 26 affixed to the case; the clamp including a U-shaped, spring tong 27 which is retained normally closed by a cross pin 28 carrying compression springs 29 that urge jaws 30 together, and thus hold a tow rope tab or plate 26 inserted through an opening 31 of the clamp 25. A bolt or other means is inserted through an opposite end opening 32 for securing the clamp to the vehicle.

In case of excessive towing pull, the tow rope tab or plate 26 is pulled out of the opening 31 by spreading the jaws apart, against the force of the springs 29, and the tow rope tab or plate 26 slips between the jaws, outwardly of the clamp 25.

Pads 33 on tabs 34 hold the case spaced from the towing vehicle, so as to not scratch the same.

In use, as shown in FIG. 1, a rewinder 10 may be supported on each side of a vehicle 35 so as to tow two skiers.

While certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

I claim:

1. An automatic tow rope rewinder, comprising, in combination, a reel inside a case, a tow rope wound around said reel, one end of said tow rope being secured to said reel while an opposite end thereof extends outwardly of said case and is attached to handle bar for being held in a hand of a skier, whereby the skier can separate from the tow rope by releasing the handle bar, two rewind springs between said case and said reel; a drain hole at the bottom of said case, and a resilient fitting mounted in a hole of said case through which said tow rope is pulled, said fitting having a plurality of circular scraper edges therewithin for scraping snow or water from said tow rope; and said case having an extended tab having a hole therethrough, a safety clamp securable to a towing vehicle having a pair of rounded jaws extending into opposite sides of said tab having a hole, and spring means urging said jaws together, whereby said tab will automatically separate from said jaws if excessive force is applied to said tow rope to thereby separate the entire rewinder from the towing vehicle.

* * * * *